US011542707B2

(12) United States Patent
Iellimo

(10) Patent No.: US 11,542,707 B2
(45) Date of Patent: Jan. 3, 2023

(54) OPTIMIZED SUPPORT BEAM

(71) Applicant: FRAZIER INDUSTRIAL COMPANY, Long Valley, NJ (US)

(72) Inventor: Domenick Iellimo, Forked River, NJ (US)

(73) Assignee: FRAZIER INDUSTRIAL COMPANY, Long Valley, NJ (US)

( * ) Notice: Subject to any disclaimer, the term of this patent is extended or adjusted under 35 U.S.C. 154(b) by 0 days.

(21) Appl. No.: 17/178,589

(22) Filed: Feb. 18, 2021

(65) Prior Publication Data

US 2022/0259861 A1 Aug. 18, 2022

(51) Int. Cl.
*E04C 3/06* (2006.01)
*E04C 3/04* (2006.01)

(52) U.S. Cl.
CPC ..... *E04C 3/06* (2013.01); *E04C 2003/0473* (2013.01)

(58) Field of Classification Search
CPC ..... E04C 3/06; E04C 2003/0473
See application file for complete search history.

(56) References Cited

U.S. PATENT DOCUMENTS 183,160 A * 10/1876 Haughian ..... E04C 3/06 428/614
2,002,044 A * 5/1935 Rothenstein ..... E04C 3/086 29/897.31
2,788,122 A * 4/1957 Kennedy ..... B65D 85/00 206/321
5,083,730 A * 1/1992 Liesegang ..... E04C 3/06 248/49
5,263,598 A * 11/1993 Vortherms ..... A47B 57/44 211/189
5,312,004 A * 5/1994 Krummell ..... B65G 1/08 211/151
5,411,154 A * 5/1995 Vargo ..... F16B 35/044 211/189
5,600,932 A * 2/1997 Paik ..... E04C 3/06 29/897.3
5,749,481 A * 5/1998 Miller ..... A47B 47/021 211/187
7,753,220 B2 * 7/2010 Konstant ..... A47B 91/00 52/693
8,727,144 B2 * 5/2014 Krummell ..... B65G 1/02 211/191
9,809,978 B2 * 11/2017 Shuhaibar ..... E04C 3/06
10,087,628 B2 * 10/2018 Shuhaibar ..... E04C 3/06
D839,080 S * 1/2019 Iellimo ..... E04C 3/293 D8/354

(Continued)

*Primary Examiner* — Rodney Mintz
(74) *Attorney, Agent, or Firm* — Dilworth & Barrese, LLP

(57) ABSTRACT

A C-beam constructed to satisfy RMI and MHI standards for supporting two 2500 lb pallets over a 96 inch span and exhibit acceptable deflection, within industry safety specifications, that previously had only been satisfied by 4 inch C-beams of over 4 lb/ft, by optimizing the web thickness and the upper and lower flange dimensions. The beam is constructed, adapted, configured and dimensioned, such that it can weigh less than about 3.7 lb/ft, even less than about 3.55 lb/ft, and when supported at each end, will support an evenly distributed load of over 2400 lb, even 2500 lb, with a deflection of less than about 1/180 of its length.

16 Claims, 4 Drawing Sheets

(56) References Cited

U.S. PATENT DOCUMENTS

| | | | | |
|---|---|---|---|---|
| D839,081 | S * | 1/2019 | Iellimo | E04C 3/06 D8/354 |
| 10,179,999 | B2 * | 1/2019 | Shuhaibar | E04C 3/06 |
| 10,400,454 | B1 * | 9/2019 | Iellimo | E04B 1/2403 |
| 10,526,140 | B2 * | 1/2020 | Iellimo | B65G 1/02 |
| 10,689,852 | B2 * | 6/2020 | Iellimo | E04B 1/19 |
| 10,858,185 | B1 * | 12/2020 | Iellimo | B65G 1/02 |
| 11,028,586 | B2 * | 6/2021 | Iellimo | B65G 1/02 |
| 2007/0175846 | A1 * | 8/2007 | Konstant | A47B 47/021 211/189 |
| 2017/0002565 | A1 * | 1/2017 | Shuhaibar | E04C 3/293 |
| 2018/0010353 | A1 * | 1/2018 | Roberts | E04C 3/06 |
| 2018/0030730 | A1 * | 2/2018 | Shuhaibar | E04C 3/06 |
| 2018/0038105 | A1 * | 2/2018 | Shuhaibar | E04C 3/293 |
| 2018/0127206 | A1 * | 5/2018 | Iellimo | B65G 1/02 |
| 2019/0338521 | A1 * | 11/2019 | Iellimo | E04B 1/5818 |
| 2020/0063435 | A1 * | 2/2020 | Iellimo | A47B 47/027 |

* cited by examiner

OPTIMIZED SUPPORT BEAM

BACKGROUND OF THE INVENTION

Storage rack systems are commonly used in warehouses, department stores, and storage facilities to store products thereon. Storage systems containing a plurality of storage racks may hold and support large amounts and often heavy materials. Often, the goods are stored on pallets, which can weigh 2000, 2400, 3000 pounds or more when fully loaded.

Storage rack systems often employ a number of vertical columns that are sturdily positioned on a base or floor. A plurality of horizontal supporting beams is often fastened to the vertical columns, such as with bolts or rivets. Typically, a number of horizontal support members are positioned directly on and substantially perpendicular to the horizontal supporting beams to provide a supporting surface for shelves, pallets, mesh surfaces, etc.

The horizontal supporting beams can be costly. They can also be heavy and therefore expensive to transport and difficult to handle safely. Accordingly, it has been desirable to provide a horizontal support beam that is strong enough to support a 2400 or 3000 pound pallet, but lighter in weight and less expensive to produce, as compared to conventional horizontal beams.

Standards for the safety and testing protocols of structures for industrial rack systems are discussed in "Specification for the Design, Testing, and Utilization of Industrial Steel Storage Racks—2012 Edition," published by Rack Manufacturers Institute, *Material Handling Industry of America*, Revision 3.2, Nov. 8, 1999. (See, e.g., https://nrsea.ru/wp-content/uploads/2017/04/Racks-RMI-Specifications-part-I.pdf) Testing machines or load-measuring apparatus should meet requirement prescribed in ASTM Methods E4. The weights of load distribution beams and other fixtures are to be measured. The beam to be tested is supported at each end and not bolted to a column. Plates can be used to prevent failure at supports or load points. See Ch. 9, test methods. The contents of this publication are incorporated herein by reference.

Accordingly, it is desirable to provide an improved beam that overcomes drawbacks of existing supporting members and satisfies RMI standards.

SUMMARY OF THE INVENTION

Generally speaking, in accordance with the invention, an improved C-beam is provided, which can support (as a pair) a 2500 lb pallet over a 48" span and two such pallets over a 96 inch span and exhibit acceptable deflection, within industry safety specifications, including RMI standards. For example, a 3.5 inch C-beam in accordance with the invention, with a weight of about 3.5 lb/ft (3.4-3.6 lb/ft), can satisfy RMI deflection standards that previously had only been satisfied by 4 inch C-beams of over about 4 lb/ft.

Beams in accordance with the invention are adapted, configured and dimensioned, such that they can weigh less than about 3.7 lb/ft and a pair of the beams, up to 106 inches long and supported at each end, can support an evenly distributed load of over 4000 lb, with a deflection of less than about 0.59 inches, pursuant to RMI specifications. Pairs of beams with a length up to 96 inches, can support an evenly distributed load of over 4800 lb, with a deflection of less than about 0.53 inches. The beam of claim 10, wherein the beam can support an evenly distributed load of over 2400 lb, with a deflection of under about 0.53 inches and the beam weighs about 3.5 pounds per foot.

Beams in accordance with the invention can have a vertical wall and top and bottom flanges, with a C-beam cross section. In general, the flanges are thickest where they meet the vertical wall and taper to a thinner end. The average thickness of the flanges should be about 1.75 to 2.25 inches, preferably about 1.9 to 2.1 inches, most preferably about 2.0 inches thick. The vertical wall should be about 0.01 to 0.15 inches, preferably 0.12 to 0.13 inches, most preferably about 0.125 inches thick. They can be formed with a ratio of a thickness of the vertical wall to an average thickness of the upper and lower flanges is about 1.25 to 2.0, preferably about 1.5 to 1.7, most preferably 1.6.

The thickness of the near end of the top and bottom flange can be about 0.2 to 0.3 inches, preferably 0.24 to 0.26 inches, most preferably about 0.25 inches and the thickness of the far end of the top and bottom flange can be about 1.25 to 2.0 inches, preferably about 1.5 to 1.7 inches, most preferably about 1.58 inches. The distance from the vertical wall to the far end of the top flange should be is about 1.5-1.65 inches, preferably about 1.55 to 1.6 inches, most preferably about 1.575 inches.

In another embodiment of the invention with a "label protecting recess, a pair of bulges extend from a second side of the vertical wall opposite the top and bottom flanges. The height of the bulges should be about 0.475 to 0.6 inches, preferably about 0.522 inches, and the depth the bulges should extend from the second side about 0.1 to 0.15 inches, preferably about 0.125 inches. The thickness of the vertical wall should be about 0.9 to 0.12 inches, preferably about 0.1 inches, the height of the junction end of the top and bottom flanges should be about 0.2 to 0.275 inches, preferably about 0.23 inches, and the thickness of the height of the far end (tip) of the top and bottom flanges should be 0.14 to 0.16 inches, preferably about 0.15 inches. The distance the bulges extend from the second surface should beabout 0.115 to 0.135 inches, preferably about 0.125 inches.

One embodiment of the beam can support an evenly distributed load of over 2400 lb, with a deflection of under about 0.53 inches and the beam weighs about 3.5 pounds per foot.

In another embodiment of the invention, the beam can support an evenly distributed load of over 2400 lb, with a deflection of under about 0.53 inches and the beam weighs about 3.5 (e.g., 3.4-2.6) pounds per foot.

DETAILED DESCRIPTION OF THE PREFERRED EMBODIMENTS

The present disclosure may be understood more readily by reference to the following detailed description of the disclosure taken in connection with the accompanying figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
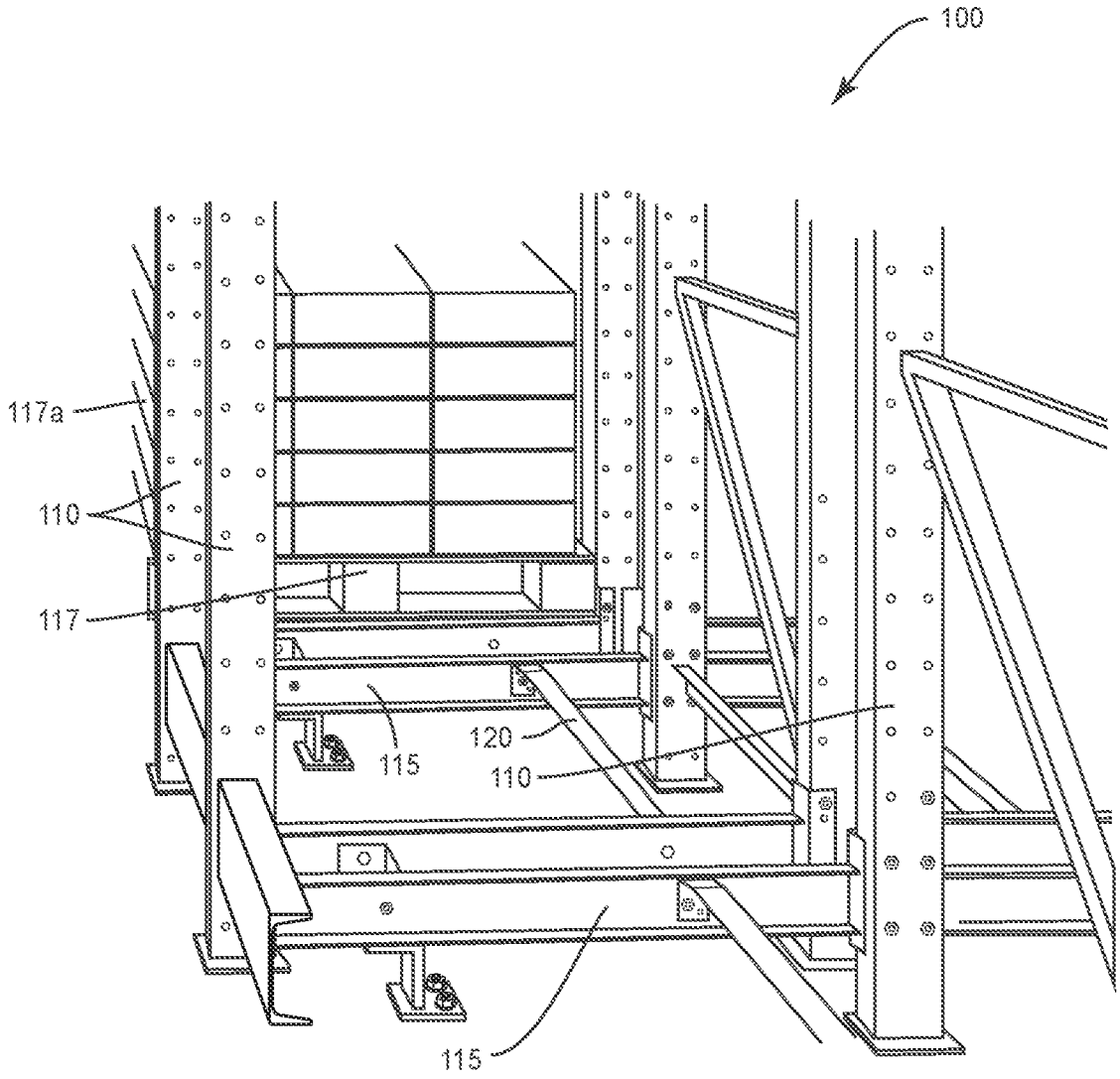
FIG. 1 is a perspective view of a storage rack system in accordance with an embodiment of the invention.

FIG. 1 illustrates an example of a fully assembled storage rack 100. A plurality of vertical columns 110 extend upward from a floor or base support surface. A plurality of horizontal beams 115 are connected to and supported by vertical columns 110. A plurality of structural support members 120 are positioned between and connected to a pair of horizontal beams 115.

A pallet 117 having goods 117*a* thereon is supported by beam 115 and structural supports 120. Storage rack 100 is intended to support multiple pallets 117. Each pallet can weight 1000-3000 pounds. The upper surfaces of platforms beams 115 and structural supports 120 should all be at substantially the same vertical height and define a horizontal plane to provide an even support surface for pallets 117.

Although FIG. 1 shows horizontal beam 115, and structural support 120 at a lower portion of vertical column 110, it should be understood that horizontal beam 115 and structural support 120 may be positioned at any location along vertical column 110. Furthermore, although FIG. 1 depicts the present disclosure being implemented on a first level, it should be understood that the present technology may also be implemented on a second level or any number of levels as well.

Figure 2:
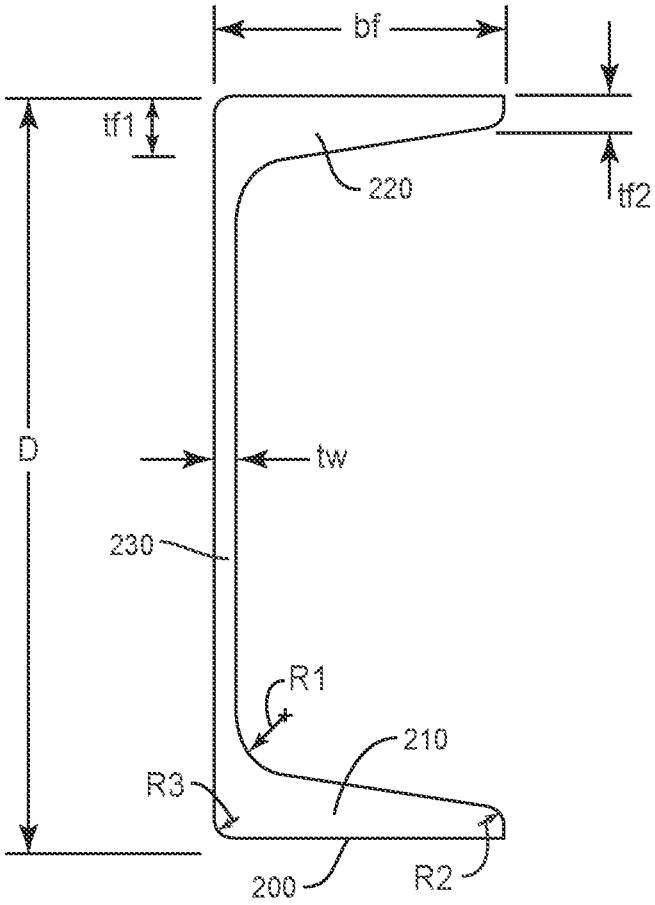
FIG. 2 is an end view of a horizontal beam in accordance with an embodiment of the invention.

A horizontal beam particularly well suited and adapted for use in a storage rack system is shown in cross-section as a beam 200 and FIG. 2. Beam 200 has a generally C-shape cross-section and is commonly referred to as a C-beam. Beam 200 includes a lower flange 210, and an upper flange 220 and a web 230. Web 230 acts as a vertical wall, connecting upper flange 220 with a lower flange 210. Beam 200 is can be hot rolled with normal rolling techniques known in the art, but can also be cold formed. It is commonly at least 48" long. Lengths of 96",108" and longer are also acceptable. Beam 200 can be welded to a pair of vertical connection flanges at each end thereof (e.g., a flange 401 shown in FIG. 4) for attachment to a vertical column. A bolt receiving hole (e.g., a hole 431 shown in FIG. 4) can be provided in a vertically central location for attachment of horizontal support members.

Beam 200 is optimally constructed with the following dimensions:

- height D of 3.5 inches ±about 2.5%, i.e., about 3.4-3.6", preferably about 3.5-3.6", more preferably about 3.544";
- width thickness tw of web (vertical wall) 230 of about 0.115-0.135", preferably 0.12-0.128", more preferably about 0.122 to 0.127", even more preferably, about 0.125";
- flange length bf of flanges 210 and 220 of about 1.5-1.65", preferably about 1.55-1.6", more preferably about 1.575";
- flange thickness tf1 at the base of flanges 210 and 220 of about 0.2"-0.3", preferably about 0.24-0.26, more preferably about 0.25";
- flange thickness tf2 at the tips of flanges 210 and 220 of about 0.14-0.17", preferably about 0.15-0.165", more preferably about 0.158";
- average flange thickness of about 0.175 to 0.225, preferably about 0.19 to 0.21 inches, most preferably about 0.2 inches;
- inside radius R1 at the joinder of flanges 210 and 220 with web 230 of about 0.11-0.13", preferably 0.115-0.125", more preferably about 0.12";
- outside radius R2 at the tips of flanges 210 and 220 of about 0.05-0.07", preferably about 0.06-0.0675", more preferably about 0.063";
- an outside radius R3 at a joinder of flanges 210 and 220 with web 230 of about 0.0275-0.04", preferably about 0.03-0.035", more preferably about 0.032".

Horizontal beams in accordance with the invention should have a weight of less than about 3.75 lb/ft, preferably a weight of about 3.25-3.75 lb/ft, more preferably about 3.4-3.6 lb/ft, even more preferably about 3.5 lb/ft.

C-beams in accordance with the invention can advantageously be formed with a ratio of web thickness to average flange thickness of about 0.5 to 0.8, preferably about 0.6 to 0.7, more preferably 0.625. Pairs of 48 inch, 96 inch, 106 inch, 108 inch and other C-beams in accordance with the invention with a weight of under 3.7 lb/ft, preferably about 3.5 lb/ft can support evenly distributed loads of over, 2000 lb, preferably over 2200 lb, more preferably over 2400 lb, with a deflection of under about 0.53 inches. Weights over 3000 lb can be supported with acceptably low deflections of under 0.53 inches can be achieved.

Figure 3:
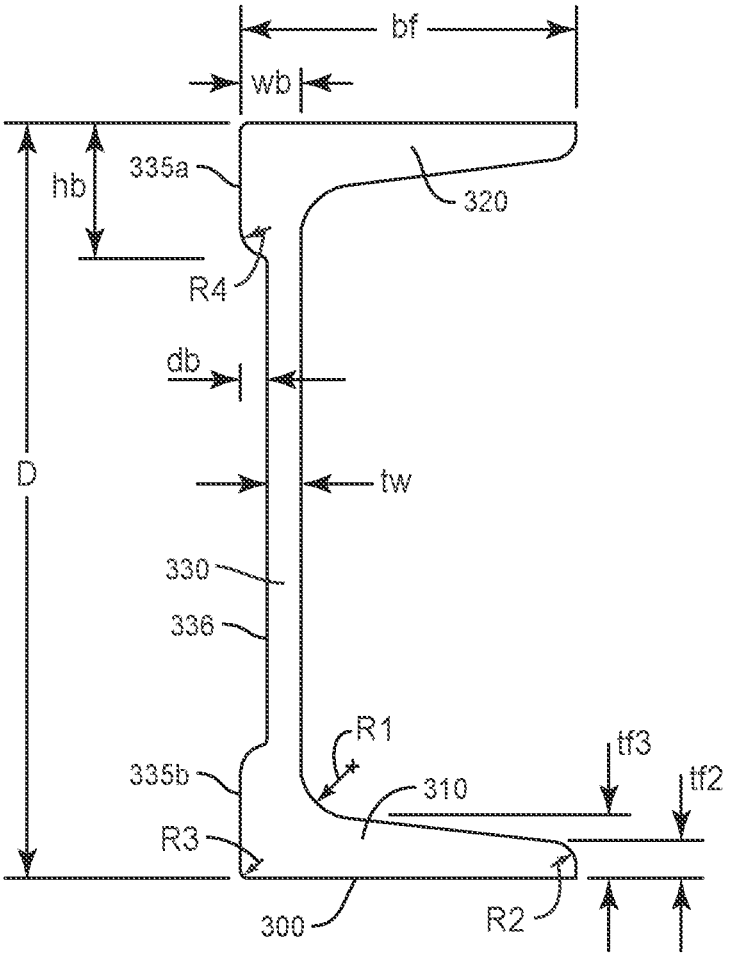
FIG. 3 is an end view of a horizontal beam in accordance with another embodiment of the invention.

A beam 300, in accordance with another embodiment of the invention is shown in cross-section in FIG. 3.

Beam 300 is similar in construction and dimensions to beam 200. It includes a lower flange 310, a top flange 320 and a connecting web (vertical wall) 330 therebetween. Beam 300 differs from the beam 200, in that beam 300 includes a lower bulge 335*a* and a lower bulge 335*b* at the respective junctions of flange 320 and flange 310 with web 330. Bulges 335*a* and 335*b* provide a central recess surface 336. Recess surface 336 provides a surface for labels, stickers and decals to be fixed to web 330. Surface 336 is protected from objects that might strike or rub against such labels as objects are moved around the warehouse.

Beam 300 can be formed with the following dimensions:

- The height of the beam D should be about 3.3 to 3.7 inches, preferably about 3.4 to 3.6 inches, most preferably about 3.544 inches;
- tw', the web width thickness is about 0.9-0.12", preferably 0.1-0.11", more preferably about 0.105";
- R2, the radius at the flange tips should be about 0.08 to 0.15 inches, preferably about 0.09 to 0.1 inches, most preferably about 0.094 inches;
- R1, the inner radius of the flanges should be about 0.11 to 0.14 inches, preferably about 0.12 to 0.13 inches, most preferably about 0.125 inches;
- R3, the outer radius of the flange corners should be about 0.025 to 0.045 inches, preferably about 0.03 to 0.04 inches, most preferably about 0.032 inches;
- R4, the inner radius of bulges 335*a* and 335*b* is about 0.1-0.15", preferably 0.11-0.13", more preferably about 0.12";
- hb, a height of bulges 335*a* and 335*b* is about 0.475-0.6", preferably 0.5-0.55", more preferably about 0.522";

wb, a width of bulges 335*a* and 335*b* is about 0.2-0.26", preferably about 0.220-0.240", more preferably about 0.230";

tf2, flange tip thickness should be about 0.1 to 0.2 inches, preferably about 0.158 inches;

tf3, flange base thickness should be about 0.2 to 0.3 inches, preferably about 0.25 inches;

db, the depth bulges 335*a* and 335*b* extend from recess surface 336 is about 0.1 to 0.15 inches, preferably 0.115 to 0.135 inches, more preferably about 0.125 inches; and tf3, a height of the base of flanges 310 and 320 is about 0.2-0.275", preferably about 0.22-0.24", more preferably about 0.23"; and bf, flange length should be about 1.4 to 1.7 inches, preferably about 1.5 to 1.6 inches more preferably about 1.575 inches.

Figure 4:
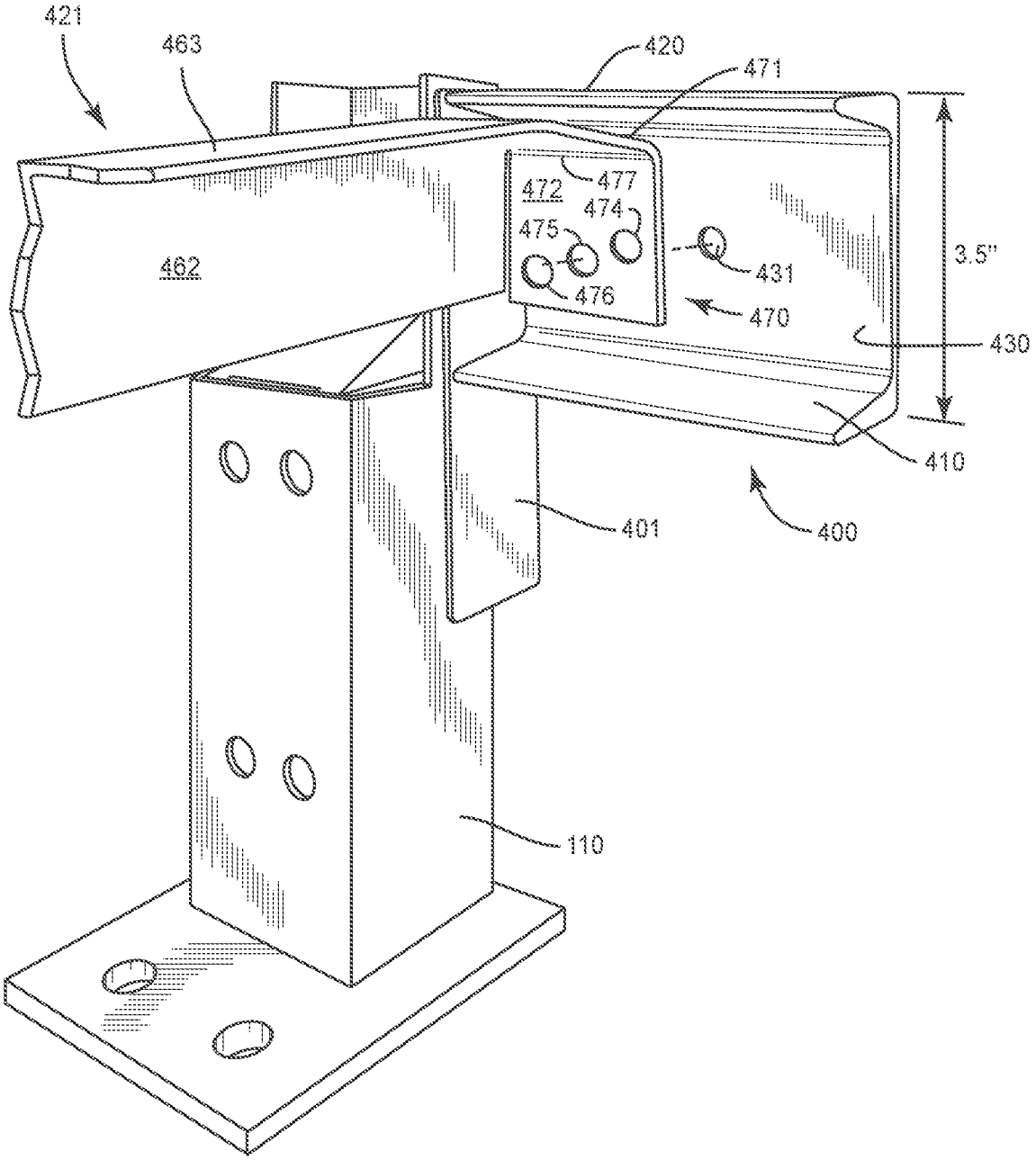
FIG. 4 is a perspective view of a vertical column, horizontal beam and support member assembly.

Referring now to FIG. 4, a horizontal beam 400 is shown welded to a connection flange 401. Flange 401 is bolted (not shown) to vertical column 110 to connect beam 400 to column 110. Beam 400 includes a lower flange 410, an upper flange 420 and a web 430 therebetween. Beam 400 has a nominal height of about 3.5 inches. Web 430 includes a bolt receiving hole 431 therethrough. Hole 431 is preferably at the approximate mid-height of beam 400, i.e., the middle of web 430. One or more holes 431 can be positioned as desired along the horizontal length of beam 400 for attaching one or more horizontal support members.

A support member 421 includes a vertical wall 462 and a load bearing upper surface 463 to help support pallets, heavy loads and the like. A connection end 470 of support member 421 has a top surface 471 and a connection flange 472. Connection flange 472 extends vertically downward from top surface 471 from a deflection line 477. Connection end 470 can be formed as an extension of upper surface 463. Top surface 471 is deflected in a downward direction from a horizontal plane defined by upper surface 463. Downwardly angled top surface 471 conveniently nests under upper flange 420 of beam 400.

Connection flange 472 includes three bolt receiving holes, 474, 475, and 476, therethrough. These three holes are positioned different distances from deflection line 477. In other embodiments of the invention, one, two or more bolt receiving holes are formed through connection flange 472. By spacing holes 474, 475, and 476 different distances from deflection line 477, support member 462 can be used with differently sized horizontal beams. For example, horizontal beams can be formed with nominal heights of 3, 3.5 and 4 inches, with a bolt receiving hole through the approximate height-wise midpoint. Therefore, hole 474 can be used to fasten support member 462 to a 3 inch horizontal beam; hole 476 can be used to fasten support member 462 to a 4 inch horizontal beam; and hole 475 can be used to fasten support member 462 to a 3.5 inch beam.

Horizontal beams constructed in accordance with the invention can satisfy strength standards previously only satisfied by available larger, heavier beams. For example, a pair of 3.5 inch beams in accordance with the invention, having a weight of about 3.5 lb/ft (e.g., about 3.4-3.6) can span widths up to 96 inches and support two evenly distributed 2500 lb pallets with acceptably low deflection as demonstrated in the following example. The example is provided for illustration and should not be construed as limiting.

The following describes the weight that can be supported by a conventional 3-inch C-beam having a weight of about 3.5 lb per foot, compared to the weight that can be properly supported by a 3.5 inch beam in accordance with the invention of approximately the same nominal weight (about 3.5 lb/ft) and therefore, which can be made from the same amount of steel. Table 1 shows the allowable deflection permitted by accepted RMI construction standards, how much weight a pair of conventional 3 inch×3.5 lb/ft beams could support and how much weight a pair of beams in accordance with the invention could support. The percentage increase is indicated.

TABLE 1

| Beam Length | Allowable deflection | C3, 3.5 lb/ft | C3.5, 3.5 lb/ft | Weight Increase |
|---|---|---|---|---|
| 92 | 0.51 in. | 4220 lb | 5340 lb | 26.5% |
| 94 | 0.52 in. | 4040 lb | 5120 lb | 26.7% |
| 96 | 0.53 in. | 3860 lb | 5000 lb | 29.5% |
| 98 | 0.54 in. | 3720 lb | 4720 lb | 26.9% |
| 100 | 0.56 in. | 3560 lb | 4520 lb | 27.0% |
| 102 | 0.57 in. | 3420 lb | 4400 lb | 28.7% |
| 104 | 0.58 in. | 3300 lb | 4180 lb | 26.7% |
| 106 | 0.59 in. | 3180 lb | 4020 lb | 26.4% |
| 108 | 0.60 in. | 3060 lb | | |
| 110 | 0.61 in. | 2940 lb | | |
| 112 | 0.62 in. | 2840 lb | | |

As shown in Table 1, beams in accordance with the invention can support over 20%, preferably over 25% more load and still exhibit the same deflection of a beam of the same weight per foot. 3.5 inch C-beams in accordance with the invention can be used in place of 4 inch C-beams and still provide acceptable deflection with respect to industry standards, with regards to supporting two 2500 lb pallets with beams up to 96".

Beams in accordance with the invention can satisfy RMI and MHI standards. For example, beams in accordance with the invention having a length of up to 106 inches or more and a weight of under about 3.7 lb/ft, preferably under about 3.6 lb/ft, and most preferably no more than about 3.55 lb/ft, will deflect less than 1/180 of their length, when subjected to a uniformly distributed load of less than about 2400 lb, preferably about 2500 lb (5000 lb for a pair of beams).

Table 2 below shows these weights per a single beam

TABLE 2

| beam length | allowable deflection | C3, 3.5 lb/ft | C3.5, 3.5 lb/ft |
|---|---|---|---|
| 92 | 0.51 | 2110 | 2670 |
| 94 | 0.52 | 2020 | 2560 |
| 96 | 0.53 | 1930 | 2500 |
| 98 | 0.54 | 1860 | 2360 |
| 100 | 0.56 | 1780 | 2260 |
| 102 | 0.57 | 1710 | 2200 |
| 104 | 0.58 | 1650 | 2090 |
| 106 | 0.59 | 1590 | 2010 |
| 108 | 0.60 | 1530 | |
| 110 | 0.61 | 1470 | |
| 112 | 0.62 | 1420 | |

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

The invention claimed is:

1. A steel structural support beam having a length extending in a horizontal direction, consisting essentially of:

a vertical wall perpendicular to the horizontal direction and having a top end and an opposite bottom end, a first side and an opposite second side, the length in the horizontal direction being about 48 inches to about 106 inches, and a nominal height of about 3.5 inches;

a top flange extending horizontally from the first side of the top end of the vertical wall, from a near end of the top flange to a far end of the top flange, a top surface of the top flange defining an upper horizontal plane and a bottom surface of the top flange inclined to the upper horizontal plane, the top flange thicker at the near end than at the far end;

a bottom flange extending horizontally from the first side of the bottom end of the vertical wall, from a near end of the bottom flange to a far end of the bottom flange, a bottom surface of the bottom flange defining a lower horizontal plane and a top surface of the bottom flange inclined to the lower horizontal plane, the bottom flange thicker at the near end than at the far end;

the beam adapted, configured and dimensioned, such that the beam weighs no more than about 3.7 pounds per foot and when supported at each end, a pair of the beams will support an evenly distributed load of about 2400 pounds to about 4000 pounds, with a deflection of less than about 1/180 of the beam's length.

2. The beam of claim 1, wherein the deflection is less than about 0.53 inches; and a vertical flange is connected to each end of each beam, the vertical flanges adapted to connect the beams to a vertical column.

3. The beam of claim 1, wherein a ratio of a thickness of the vertical wall to an average thickness of the upper and lower flanges is about 0.5 to 0.8.

4. The beam of claim 1, wherein a ratio of a thickness of the vertical wall to an average thickness of the upper and lower flanges is about 0.4 to 0.6.

5. The beam of claim 1, wherein a thickness of the vertical wall is less than about 0.13 inches.

6. The beam of claim 1, wherein a thickness of the vertical wall is about 0.12 to 0.13 inches.

7. The beam of claim 1, wherein a thickness of the near end of the top and bottom flange is about 0.2 to 0.3 inches and a thickness of the far end of the top and bottom flange is about 0.14 to 0.17 inches.

8. The beam of claim 7, wherein a thickness of the vertical wall is about 0.12 to 0.13 inches.

9. The beam of claim 1, wherein a distance from the vertical wall to the far end of the top flange is about 1.5-1.65 inches.

10. The beam of claim 9, wherein the distance from the vertical wall to the far end of the top flange is about 1.55-1.6 inches.

11. A steel structural support beam having a length extending in a horizontal direction, consisting essentially of:

a vertical wall perpendicular to the horizontal direction and having a top end and an opposite bottom end, a first side and an opposite second side, the length in the horizontal direction being about 48 inches to about 106 inches, and a nominal height of about 3.5 inches;

a top flange extending horizontally from the first side of the top end of the vertical wall, from a near end of the top flange to a far end of the top flange, a top surface of the top flange defining an upper horizontal plane and a bottom surface of the top flange inclined to the upper horizontal plane, the top flange thicker at the near end than at the far end;

a bottom flange extending horizontally from the first side of the bottom end of the vertical wall, from a near end of the bottom flange to a far end of the bottom flange, a bottom surface of the bottom flange defining a lower horizontal plane and a top surface of the bottom flange inclined to the lower horizontal plane, the bottom flange thicker at the near end than at the far end;

the beam adapted, configured and dimensioned, such that the beam weighs no more than about 3.7 pounds per foot and when supported at each end, a pair of the beams will support an evenly distributed load of about 2400 pounds to about 4000 pounds, with a deflection of less than about 1/180 of the beam's length;

wherein a pair of bulges extend from the second side of the vertical wall, opposite the top and bottom flanges respectively, a height of the bulges being about 0.475 to 0.6 inches and a depth the bulges extend from the second side is about 0.1 to 0.15 inches.

12. The beam of claim 11, wherein a thickness of the vertical wall is about 0.9 to 0.12 inches, a height of the near end of the top and bottom flange is about 0.2 to 0.275 inches, and a thickness of the height of the far end to the top and bottom flange is 0.14 to 0.16 inches.

13. The beam of claim 12, wherein a distance the bulges extend from the second side is about 0.115 to 0.135 inches.

14. A steel structural support beam having a length extending in a horizontal direction, consisting essentially of:

a vertical wall perpendicular to the horizontal direction and having a top end and an opposite bottom end, a first side and an opposite second side, the length in the horizontal direction being about 48 inches to about 106 inches, and a nominal height of about 3.5 inches;

a top flange extending horizontally from the first side of the top end of the vertical wall, from a near end of the top flange to a far end of the top flange, a top surface of the top flange defining an upper horizontal plane and a bottom surface of the top flange inclined to the upper horizontal plane, the top flange thicker at the near end than at the far end;

a bottom flange extending horizontally from the first side of the bottom end of the vertical wall, from a near end of the bottom flange to a far end of the bottom flange, a bottom surface of the bottom flange defining a lower horizontal plane and a top surface of the bottom flange inclined to the lower horizontal plane, the bottom flange thicker at the near end than at the far end;

the beam adapted, configured and dimensioned, such that the beam weighs no more than about 3.7 pounds per foot and when supported at each end, a pair of the beams will support an evenly distributed load of about 2400 pounds to about 4000 pounds, with a deflection of less than about 1/180 of the beam's length;

wherein the beam has a vertical flange connected to each end of the beam, the vertical flanges adapted to connect the beam to a vertical column.

15. A system, consisting essentially of:

a plurality of steel structural support beams, each beam having:

a length extending in a horizontal direction;

a vertical wall perpendicular to the horizontal direction and having a top end and an opposite bottom end, a first side and an opposite second side, the length in the horizontal direction being about 48 inches to about 106 inches, and a nominal height of about 3.5 inches;

a top flange extending horizontally from the first side of the top end of the vertical wall, from a near end of the top flange to a far end of the top flange, a top surface of the top flange defining an upper horizontal plane and a bottom surface of the top flange inclined to the upper horizontal plane, the top flange thicker at the near end than at the far end;

a bottom flange extending horizontally from the first side of the bottom end of the vertical wall, from a near end of the bottom flange to a far end of the bottom flange, a bottom surface of the bottom flange defining a lower horizontal plane and a top surface of the bottom flange inclined to the lower horizontal plane, the bottom flange thicker at the near end than at the far end;

the beam adapted, configured and dimensioned, such that the beam weighs no more than about 3.7 pounds per foot and when supported at each end, a pair of the beams will support an evenly distributed load of about 2400 pounds to about 4000 pounds, with a deflection of less than about 1/180 of the beam's length.

16. A system, consisting essentially of:

a plurality of steel structural support beams, each beam having:

a length extending in a horizontal direction;

a vertical wall perpendicular to the horizontal direction and having a top end and an opposite bottom end, a first side and an opposite second side, the length in the horizontal direction being about 48 inches to about 106 inches, and a nominal height of about 3.5 inches;

a top flange extending horizontally from the first side of the top end of the vertical wall, from a near end of the top flange to a far end of the top flange, a top surface of the top flange defining an upper horizontal plane and a bottom surface of the top flange inclined to the upper horizontal plane, the top flange thicker at the near end than at the far end;

a bottom flange extending horizontally from the first side of the bottom end of the vertical wall, from a near end of the bottom flange to a far end of the bottom flange, a bottom surface of the bottom flange defining a lower horizontal plane and a top surface of the bottom flange inclined to the lower horizontal plane, the bottom flange thicker at the near end than at the far end;

the beam adapted, configured and dimensioned, such that the beam weighs no more than about 3.7 pounds per foot and when supported at each end, a pair of the beams will support an evenly distributed load of about 2400 pounds to about 4000 pounds, with a deflection of less than about 1/180 of the beam's length;

wherein a pair of bulges extend from the second side of the vertical wall, opposite the top and bottom flanges respectively, a height of the bulges being about 0.475 to 0.6 inches and a depth the bulges extend from the second side is about 0.1 to 0.15 inches.

* * * * *